United States Patent [19]

Kikuchi

[11] Patent Number: 4,854,757

[45] Date of Patent: Aug. 8, 1989

[54] AUTOMATIC SHEET FEEDER MOVABLE BETWEEN ACTIVE AND INACTIVE POSITIONS

[75] Inventor: Kiyoji Kikuchi, Tokyo, Japan

[73] Assignee: Kabushiki Kaisha Toshiba, Kawasaki, Japan

[21] Appl. No.: 107,413

[22] Filed: Oct. 13, 1987

[30] Foreign Application Priority Data

Oct. 13, 1986 [JP] Japan ..... 61-242689

[51] Int. Cl.[4] ..... B41J 11/00; B41J 13/00; B41J 15/00

[52] U.S. Cl. ..... 400/605; 400/625; 271/3

[58] Field of Search ..... 400/605, 624, 625, 626, 400/627, 628, 629; 271/3, 3.1

[56] References Cited

U.S. PATENT DOCUMENTS

| | | | |
|---|---|---|---|
| 1,417,597 | 5/1922 | Gallien | 400/629 |
| 1,923,771 | 8/1933 | Barney | 400/629 |
| 2,887,208 | 5/1959 | Cross | 400/629 |
| 4,067,566 | 1/1978 | Williams | 400/625 X |
| 4,326,815 | 4/1982 | Kapp | 400/629.X |
| 4,341,480 | 7/1982 | Mailer | 400/625 |
| 4,391,542 | 7/1983 | Baitz | 400/624 X |
| 4,522,519 | 6/1985 | Dubois | 400/629 X |
| 4,570,923 | 2/1986 | Hooper et al. | 271/275 |
| 4,606,663 | 8/1986 | Christoph et al. | 400/605 |
| 4,688,957 | 8/1987 | Prevignano | 400/625 X |

FOREIGN PATENT DOCUMENTS

| | | | |
|---|---|---|---|
| 0073980 | 4/1984 | Japan | 400/605 |
| 0191948 | 9/1985 | Japan | 400/624 |
| 60-154143 | 10/1985 | Japan . | |
| 2156280 | 10/1985 | United Kingdom . | |

*Primary Examiner*—Ernest T. Wright, Jr.
*Attorney, Agent, or Firm*—Finnegan, Henderson, Farabow, Garrett & Dunner

[57] ABSTRACT

A printer includes a printer body and an automatic sheet feeder. The printer body has a case in which a printing mechanism and a continuous paper feeding mechanism are arranged. An upper wall of the case has a cut sheet supply port and a paper discharge port formed therein, both of which are located close to the printing mechanism. The sheet feeder is mounted on the case such that it can be pivoted between an actuating position, where it covers the supply and discharge ports, and a non-actuating position, where it does not interfere with the discharging of the continuous paper from the discharging port. At the actuating position, the sheet feeder supplies a cut sheet through the supply port to the printing mechanism.

11 Claims, 5 Drawing Sheets

AUTOMATIC SHEET FEEDER MOVABLE BETWEEN ACTIVE AND INACTIVE POSITIONS

BACKGROUND OF THE INVENTION

The present invention relates to an automatic sheet feeder for a printer capable of selectively printing continuous paper and cut sheets.

A printer of this type includes a printer body and an automatic sheet feeder, detachably arranged on the printer body, for feeding cut sheets to the printer body. The printer body includes a tractor for conveying continuous paper to a printing mechanism, and a case for covering these parts. The case includes an upper wall in which a paper discharge port and a cut sheet supply port are formed, and a rear wall in which a continuous paper supply port is formed. When continuous paper is to be printed on, the automatic sheet feeder is first of all detached from the printer body, so as not to interfere with the discharge of the continuous paper. Following printing, the continuous paper is then inserted into the case, through the continuous paper supply port, and then conveyed to the printing mechanism by the tractor. The printed continuous paper is discharged from the case through the paper discharge port, and conveyed along the upper wall to behind the case.

When a cut sheet is to be printed on, the automatic sheet feeder is mounted on the upper wall of the case, to cover the cut sheet supply port and paper discharge port. The cut sheets stacked in a cassette incorporated in the sheet feeder are fed one by one by a feed roller, through the cut sheet supply port, to the printing mechanism inside the case. The printed-on cut sheets are guided through the paper discharge port of the case, back into the sheet feeder, and stacked, by a discharge roller, at a predetermined location therewithin.

Thus, in the case of the above printer, the automatic sheet feeder having a mechanism for feeding cut sheets is selectively mounted on the printer body having a mechanism for feeding continuous paper, thereby enabling printing on continuous paper or cut sheets. However, this means that the automatic sheet feeder must be alternately mounted and detached, depending on the printing mode—for continuous paper or for cut sheets—selected. Frequent changes in printing mode make this operation both cumbersome and time-consuming. Furthermore, additional space is required for storing the automatic sheet feeder when it is detached from the printer.

With the aim of solving the above-described problems, a printer has been proposed in which continuous paper is printed without the need to detach an automatic sheet feeder from the printer body, the printed-on continuous paper being discharged from the printer through the inside of the automatic sheet feeder. In this case, however, the following problems arise: The continuous paper is pulled by the discharging mechanism of the automatic sheet feeder while, at the same time, being pushed by the feeding mechanism of the printer body. Since the operations of the feeding and discharging mechanisms are not perfectly synchronized, the precision regarding feeding of the continuous paper is degraded. As a result, the printing position (carriage return position) is shifted from that desired, and hence accurate printing cannot be performed. Furthermore, when continuous paper is discharged through the inside of the automatic sheet feeder, the continuous paper tends to be caught by, for example, the cut sheet cassette or a discharged paper stacker. Consequently, it is difficult to smoothly discharge the printed-on continuous paper. In addition, since the paper discharge port is blocked by the automatic sheet feeder, printed continuous paper cannot be cut off at a position immediately after the printed-on portion, i.e., close to the printing mechanism.

SUMMARY OF THE INVENTION

The present invention has been developed in consideration of the above situation, and has as its object to provide an automatic sheet feeder for a printer, which can be easily switched back and forth by way of a simple operation, and does not prevent printing on the continuous paper.

In order to achieve the above object, according to the present invention, there is provided an automatic sheet feeder for a printer including a case, a printing mechanism arranged in the case, the case having a cut sheet supply port and a paper discharge port, near to the printing mechanism, and a continuous paper feeding mechanism arranged in the case, for feeding continuous paper toward the printing mechanism, printed-on continuous paper being discharged from the case through the paper discharge port; the automatic sheet feeder comprising: a main body mounted on the case of the printer to be movable between an actuating position, where the main body covers the cut sheet supply port and the paper discharge port, and a non-actuating position, where the main body does not interfere with the discharging of the continuous paper from the case; a cut sheet feeding mechanism for feeding a cut sheet through the cut sheet supply port to the printing mechanism, when the main body is moved to the actuating position; and a cut sheet stacking mechanism for stacking the cut sheet discharged through the paper discharge port, when the main body is moved to the actuating position.

BRIEF DESCRIPTION OF THE DRAWINGS

FIGS. 1 to 5 show a printer having an automatic sheet feeder according to an embodiment of the present invention, in which:

FIG. 1 is a perspective view of the printer in a state wherein the automatic sheet feeder is located at a non-actuating position, FIG. 2 is a sectional view of the printer in the state of FIG. 1, FIG. 3 is an exploded perspective view of a hinge portion, FIG. 4 is a sectional view of the hinge portion, and FIG. 5 is a sectional view of the printer in a state wherein the sheet feeder is located at an actuating position.

DETAILED DESCRIPTION OF THE PREFERRED EMBODIMENTS

Embodiments of the present invention will be described in detail with reference to the accompanying drawings.

Figure 1:
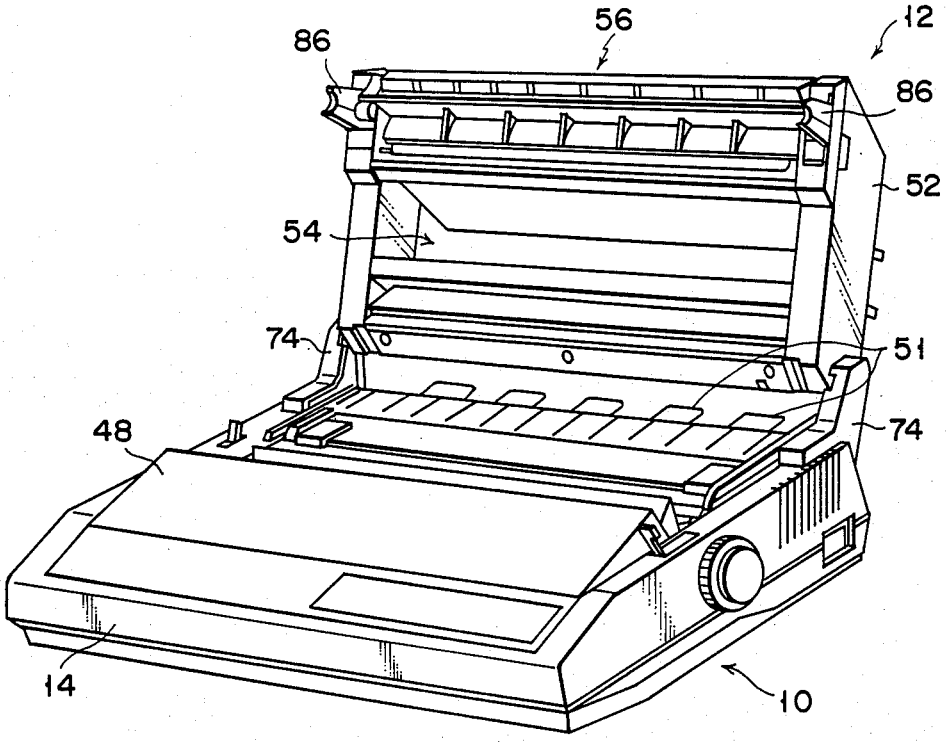
Figure 2:
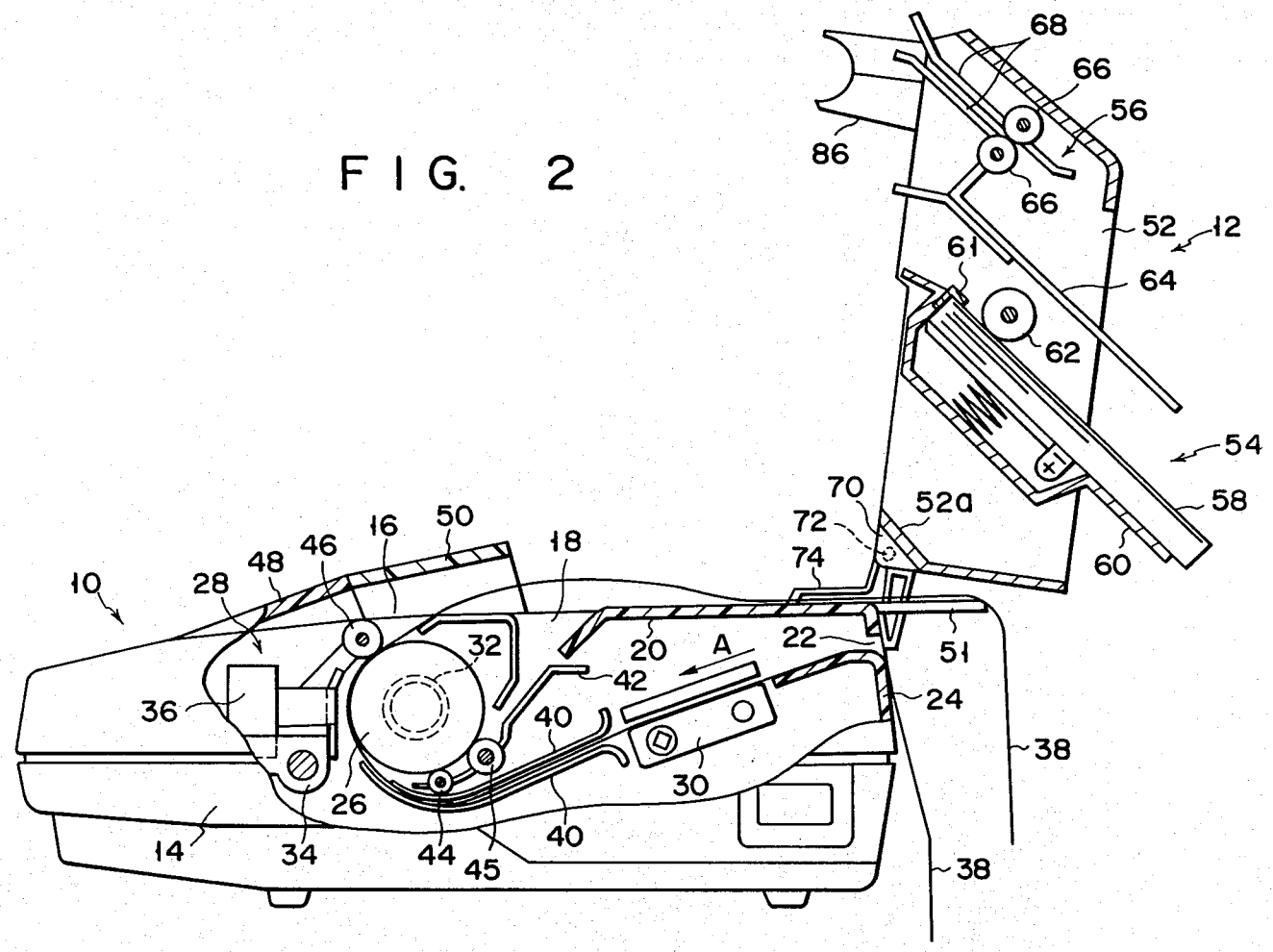
Figure 3:
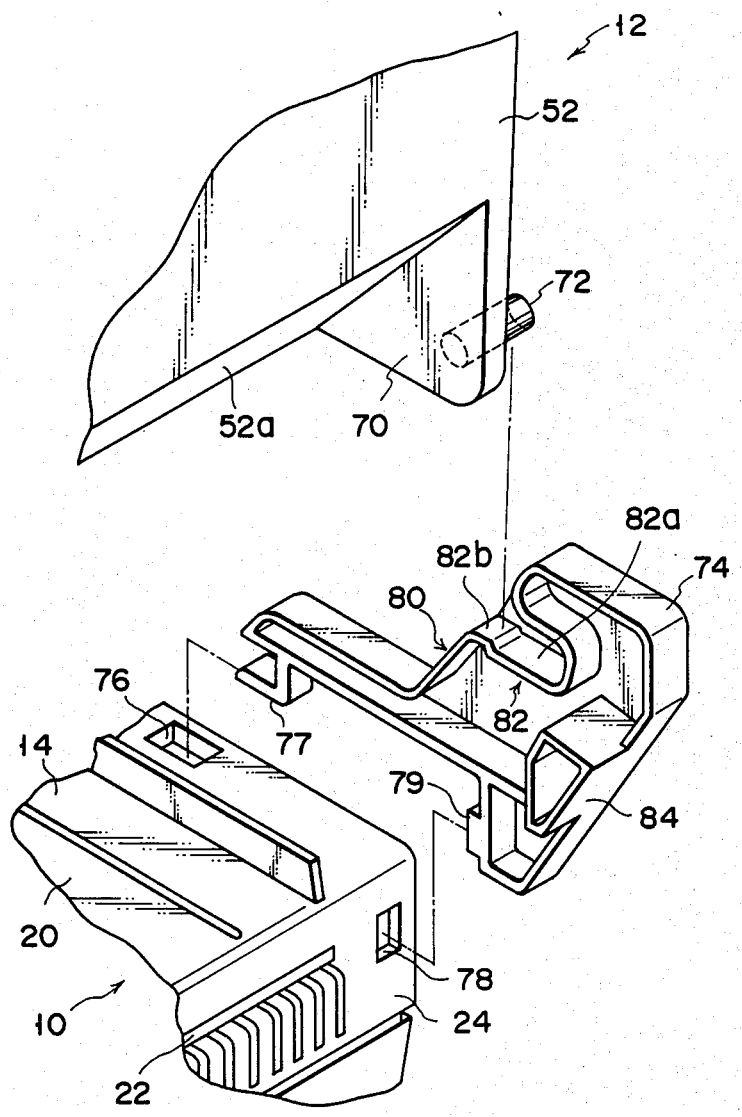

As is shown in FIGS. 1 and 2, a serial printer comprises printer body 10 and automatic sheet feeder 12 arranged on the printer body 10.

Printer body 10 will be described below. Printer body 10 includes case 14. Case 14 includes upper wall 20 having paper discharge port 16 and cut sheet supply port 18, and rear wall 24 extending downward from a rear end of upper wall 20 in a substantially vertical direction and having continuous paper supply port 22. Printing mechanism 28 and tractor 30 are arranged in case 14. Printing mechanism 28 includes platen 26, both ends of which are supported by bearings 32. Platen 26 is located near paper discharge port 16 and cut sheet supply port 18, and extends horizontally. Printing mechanism 28 includes carriage 34 arranged to be movable along the axial direction of platen 26, and printing head 36 arranged on carriage 34 to oppose platen 26. Tractor 30 is located between continuous paper supply port 22 and platen 26 and transfers continuous paper 38 inserted from supply port 22 into case 14 toward platen 26. A pair of guide plates 40 for guiding continuous paper 38 are arranged between tractor 30 and platen 26. In case 14 are arranged guide plate 42 for guiding a cut sheet 58, which is introduced from supply port 18 into case 14, to platen 26, a pair of friction rollers 44 and 45 capable of being urged against the outer surface of platen 26, and bail roller 46 for urging continuous paper 38 against the outer surface of platen 26. Front cover 48 and soundproof cover 50 are detachably mounted on upper wall 20 to cover discharge port 16, respectively. Note that in FIGS. 1 and 2, a plurality of separators 51 horizontally extend backward from the rear end portion of upper wall 20. These separators 51 serve to guide discharged continuous paper 38. Each separator 51 has an appropriate length so as to prevent printed continuous paper 38 from interfering with continuous paper supply port 22.

Automatic sheet feeder 12 includes rectangular case 52, in which cut sheet feeding mechanism 54 and cut sheet stacking mechanism 56 are arranged. Feeding mechanism 54 has paper cassette 60 storing a plurality of cut sheets 58 in a stacking state, separating pawl 61 arranged on paper cassette 60 to restrict feeding of the cut sheets 58, and feed roller 62, urged against the uppermost sheet of cut sheets 58 stacked on paper cassette 60, for feeding the cut sheets 58 one by one. In addition, cut sheet stacking mechanism 56 includes stacker 64 for stacking printed cut sheets 58, a pair of discharge rollers 66 for transferring a cut sheet discharged from printer body 10 to stacker 64, and guide plates 68 for guiding the transfer of the cut sheet 58.

Figure 4:
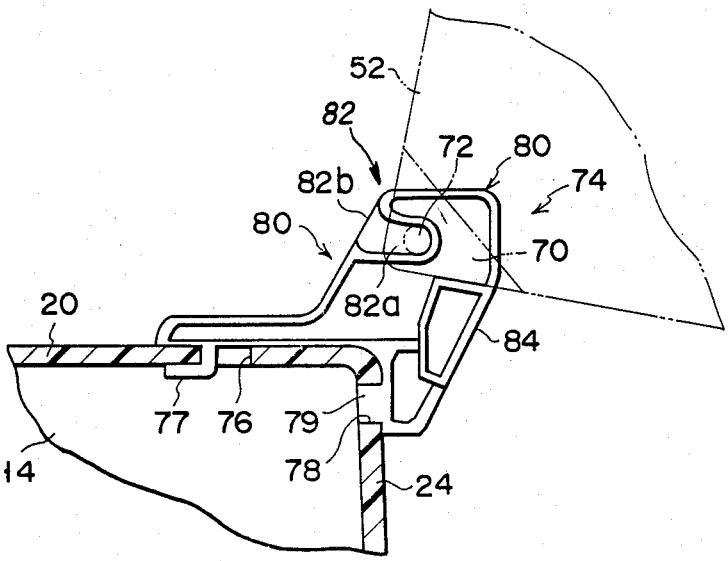

Sheet feeder 12 is mounted on printer body 10 to be movable between the non-actuating position shown in FIG. 2 and the actuating position shown in FIG. 4. More specifically, as is shown in FIGS. 1 to 4, a lower portion of case 52 of paper feeder 12 is obliquely cut on the rear end side thereof to form notched portion **52*a*. Support plates 70 vertically extend from the right and left ends of notched portion 52*a*, and hinge pins 72 horizontally extend outward from support plates 70, respectively. A pair of hinge members 74 are arranged on the both sides of the rear portion of upper wall 20 of printer body 10 at a predetermined interval therebetween. Hinge pins 72 of sheet feeder 12 are pivotally supported by hinge members 74. Each hinge member 74, as apparent from FIGS. 3 and 4, includes first projection 77, which is fitted into hole 76 formed on upper wall 20 of case 14, and second projection 79, which is fitted into hole 78 formed on rear wall 24 of case 14, and is detachably mounted on the case 14. In addition, each hinge member 74 includes projecting portion 80 extending obliquely and upwardly from case 14. Projecting portion 80 is formed with support hole 82 in which hinge pin 72 is pivotally inserted. Support hole 82 has horizontal portion 82*a* and insertion portion 82*b*, which obliquely and upwardly extends from the left end of horizontal portion 82*a* and opens at the side wall of projecting portion 80. Hinge pin 72 is inserted into horizontal portion 82*a* through insertion portion 82*b*. Thus, sheet feeder 12 can pivot about hinge pins 72. Note that sheet feeder 12 can be detached from printer body 10 by pulling hinge pins 72 off from support holes 82 through insertion portions 82*b***, respectively.

Each hinge member 74 includes stopper 84 extending inward. When sheet feeder 12 is pivoted to the non-actuating position, an edge of support plate 70 is brought into contact with stopper 84, as is shown in FIGS. 2 and 4, so that sheet feeder 12 is kept at the non-actuating position.

Sheet feeder 12 also includes right and left support arms 86 extending from the lower end of the front portion of case 52. When sheet feeder 12 is pivoted to the actuating position, these arms 86 are respectively mounted on bearings 32 of platen 26, thereby supporting the sheet feeder 12.

An operation of the printer having the above-described arrangement will now be described.

When continuous paper 38 is to be printed, automatic sheet feeder 12 is pivoted about hinge pins 72 to the non-actuating position and is kept at this position. Friction rollers 44 and 45 are released from a state wherein they are urged against platen 26. In this state, tractor 30 is driven. Continuous paper 38 supplied from supply port 22 into case 14 is transferred by tractor 30 in a direction indicated by arrow A, and guided by guide plate 40 to a position between platen 26 and printing head 36. Subsequently, continuous paper 38 is temporarily stopped in a state wherein the distal end of paper 38 is urged against the outer surface of platen 26 by bail roller 46. Then, printing head 36 mounted on carriage 34 is moved in the axial direction of platen 26, and one line is printed on continuous paper 38. Thereafter, continuous paper 38 is transferred by tractor 30 in the direction indicated by arrow A by a predetermined amount, and then the next line is printed on paper 38. The printed continuous paper 38 is discharged outside case 14 through paper discharge port 16, guided to separators 51 sliding on upper wall 20 of case 14, and fed downward from the distal ends of separators 51. Since each separator 51 has a sufficient length for guiding the paper 38, the printed continuous paper 38 is smoothly discharged without interfering with continuous paper 38 to be introduced to supply port 22. Line printing of continuous paper 38 is repeated in the above-described manner.

Automatic sheet feeder 12 pivoted to the non-actuating position is sufficiently spaced apart from paper discharge port 16, and hinge pins 72 are supported by hinge members 74 extending upward from upper wall 20 of printer body 10. Therefore, case 52 of sheet feeder 12 is kept to be sufficiently separated from upper wall 20 and separators 51 of case 14. Accordingly, no member, which interferes with discharging of the continuous paper 38 is located in a discharge path through which the printed continuous paper 38 is transferred from paper discharge port 16 to the extending portions of separators 51, and hence the printed continuous paper 38 can be smoothly discharged.

Figure 5:
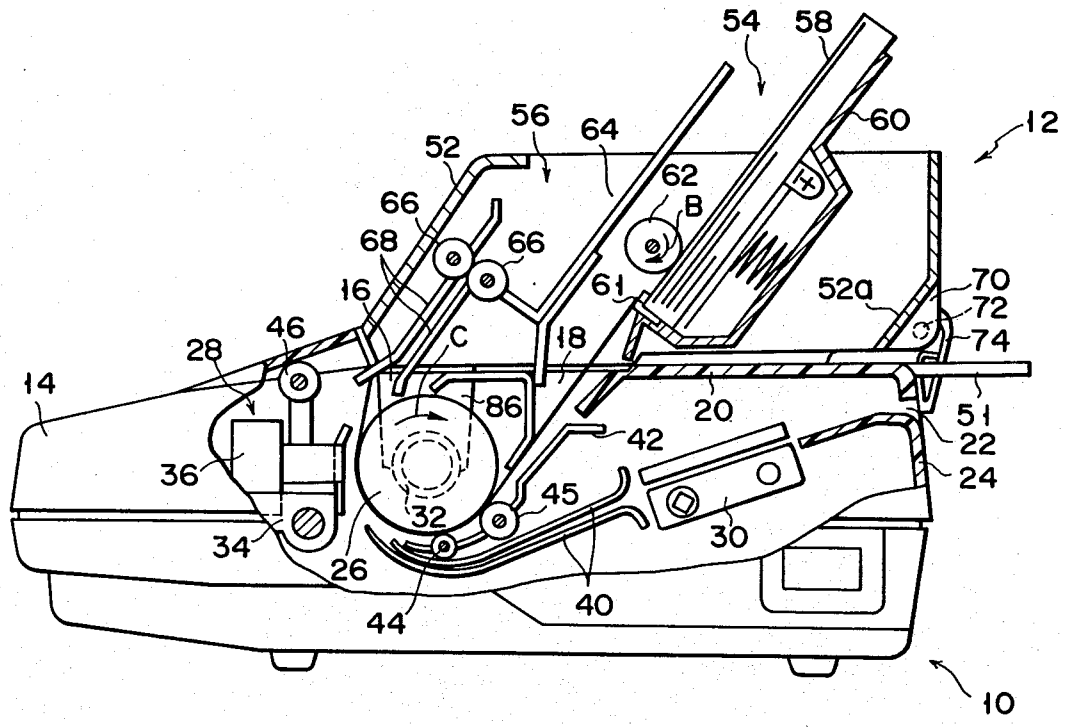
Figure 6:
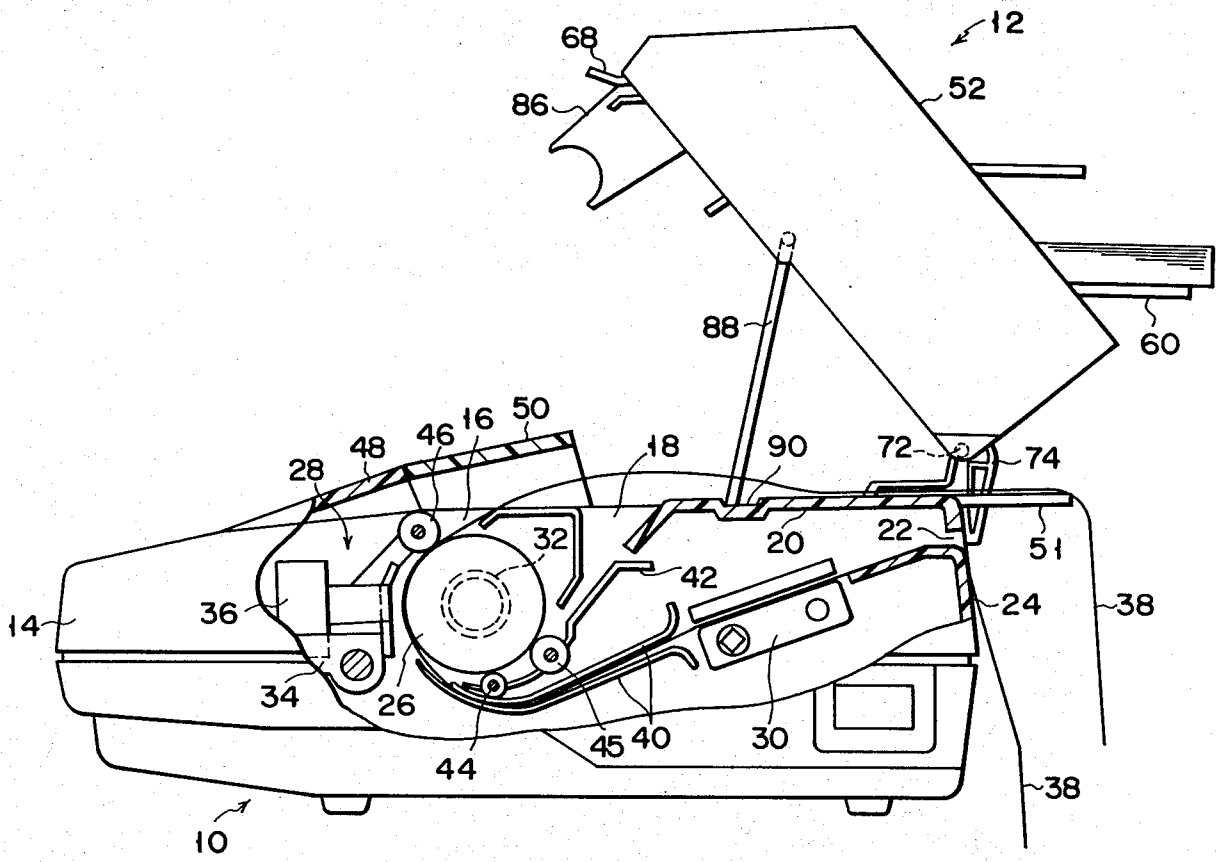
FIG. 6 is a partially cutaway side view of a printer according to another embodiment of the present invention.

When cut sheet 58 is to be printed, soundproof cover 50 is removed from printer body 10, as is shown in FIG. 5, and automatic sheet feeder 12 is pivoted about hinge pins 72 to the actuating position. Subsequently, a pair of support arms 86 are mounted on corresponding bearings 32 of platen 26, so that sheet feeder 12 is kept at the actuating position. At this position, sheet feeder 12 is located to cover cut sheet supply port 18 and paper discharge port 16 of printer body 10, while a pick-up portion of cut sheet feeding mechanism 54 communicates with supply port 18, and distal end portions of guide plates 68 of cut sheet stacking mechanism 56 extend into case 14 through discharge port 16. Prior to feeding of cut sheet 58, bail roller 46 is separated from platen 26 and friction rollers 44 and 45 are urged against the outer surface of platen 26 by a switching mechanism (not shown). Furthermore, continuous paper 38 set in tractor 30 is moved out of a path for the cut sheet 58, and transmission of a driving force to the tractor 30 is stopped.

When printing is started in this state, feed roller 62 urged against the uppermost cut sheet among cut sheets 58 stacked in paper cassette 60 is rotated by a drive source (not shown) in a direction indicated by arrow B. Subsequently, uppermost cut sheet 58 is pushed out from cassette 60 toward printer body 10, passes over separating pawl 61 to be separated from the other cut sheets 58, and is fed to a position between platen 26 and friction rollers 44 and 45 through cut sheet supply port 18. Then, feed roller 62 is stopped, and platen 26 is rotated in a direction indicated by arrow C. Thus, cut sheet 58 is transferred so that its distal end is introduced between guide plates 68 through a path between platen 26 and printing head 36.

After cut sheet 58 is transferred to a predetermined printing position in the above-described manner, printing head 36 together with carriage 34 is moved in the axial direction of platen 26. Thus, cut sheet 58 is printed by printing head 36 in units of lines. Every time each line is printed, platen 26 is rotated in the direction indicated by arrow C by a predetermined amount, thereby feeding the sheet 58. After printing is completed, cut sheet 58 is introduced between discharge rollers 66 being guided by guide plates 68, and transferred to stacker 64 upon rotation of discharge rollers 66 and stacked therein.

Thereafter, printing of cut sheets 58 is repeated in the same steps as described above.

The printer having the above-described arrangement includes the following advantages. Since automatic sheet feeder 12 is mounted on the printer body 10 to be pivotal between the actuating and non-actuating positions, automatic feeding of continuous paper 38 and cut sheets 58 can be switched, without detaching sheet feeder 12 from the printer body 10, by a simple operation, i.e., pivoting sheet feeder 12. Further, no space is required for keeping detached automatic sheet feeder 12. When continuous paper 38 is to be printed, automatic sheet feeder 12 is kept at a position out of the discharge path for the continuous paper 38, i.e., at the non-actuating position where discharging of the continuous paper 38 is not interfered with at all. As a result, the continuous paper 38 can be smoothly discharged. At the non-actuating position, sheet feeder 12 is sufficiently separated from paper discharge port 16 of printer body 10, so that the continuous paper 38 can be cut off near the printing position. Furthermore, since the discharged continuous paper 38 does not pass through the inside of automatic sheet feeder 12, the continuous paper 38 is not affected by a tension caused by discharge rollers 66. Consequently, a feed amount of continuous paper 38 can be accurately controlled by tractor 30 and rotation of platen 26, and hence line-feed of the continuous paper 38 during the printing mode can be accurately performed. As a result, high-density printing can be performed. When automatic sheet feeder 12 fails or is kept unused for a long period of time, it can be detached from printer body 10 by a simple operation, i.e., pulling hinge pins 72 off from support holes 82 of hinge members 74.

Note that the present invention is not limited to the above-described embodiment, and various changes and modifications may be made within the spirit and scope of the invention.

For example, although in the above embodiment, automatic sheet feeder 12 is kept at the non-actuating position by the stoppers 84 formed on the hinge members 74, sheet feeder 12 can be kept at the non-actuating position by support rod 88. In this case, one end of rod 88 is pivotally supported by case 52 of sheet feeder 12. In the non-actuating position of paper feeder 12, the other end of rod 88 is fitted and positioned in recess 90 formed in upper wall 20 of printer body 10. At the actuating position, support rod 88 is pivoted toward hinge pins 72 of sheet feeder 12 and housed between sheet feeder 12 and printer body 10.

In the above-described embodiments, the automatic sheet feeder 12 is pivotally arranged between the actuating and non-actuating positions. However, the automatic sheet feeder is not limited to the above arrangement, and may be supported by a link mechanism or the like to be linearly movable between the above two positions.

What is claimed is:

1. An automatic sheet feeder for a printer capable of printing continuous paper and cut sheets, the printer including a case with an upper wall, a printing mechanism arranged in the case, the upper wall having a cut sheet supply port and a paper discharge port, near to the printing mechanism, and a continuous paper feeding mechanism arranged in the case, for feeding continuous paper toward the printing mechanism, printed-on continuous paper being discharged from the case through the paper discharge port and transferred on the upper wall, said automatic sheet feeder comprising:

a main body arranged on the upper wall of the case of the printer to be movable between an actuating position, where the main body covers the cut sheet supply port and the paper discharge port, and a non-actuating position, where a discharge path, through which the discharged continuous paper is transferred, is defined between the main body and the upper wall of the case;

a cut sheet feeding mechanism arranged in the main body, for feeding a cut sheet through the cut sheet supply port to the printing mechanism, when the main body is moved to the actuating position; and a cut sheet stacking mechanism arranged in the main body, for stacking cut sheets discharged through the paper discharge port, when the main body is moved to the actuating position.

2. An automatic sheet feeder according to claim 1, which further comprises a pivoting mechanism for supporting the main body on the case to be pivotal between the actuating and non-actuating positions.

3. An automatic sheet feeder according to claim 2, wherein the upper wall has a rear end separated from the cut sheet supply port and the paper discharge port; the case includes a rear wall extending downward from the rear end of the upper wall, and a continuous paper supply port formed in the rear wall; and the pivoting mechanism is arranged near the rear end of the upper wall.

4. An automatic sheet feeder according to claim 3, wherein said pivoting mechanism includes a pair of hinge members arranged on the case, near the rear end of the upper wall, and a pair of hinge pins fixed to the main body and pivotally supported by the hinge members, respectively.

5. An automatic sheet feeder according to claim 4, wherein each of said hinge members includes a projecting portion which projects upward from the upper wall, and a support hole which is formed in the projecting portion and has an insertion portion open to an outer surface of the hinge member, and each of said hinge pins is pivotally supported in the support hole such that the hinge pin can be pulled out therefrom through the insertion portion.

6. An automatic sheet feeder according to claim 4, wherein at least one of said hinge members has a stopper for abutting against the sheet feeder and holding the sheet feeder at the non-actuating position when the sheet feeder is pivoted thereto.

7. A printer according to claim 4, wherein said hinge members are detachably mounted on the case.

8. A printer according to claim 2, which further comprises holding means for holding the sheet feeder at the non-actuating position, the holding means including a support rod having two ends one of which is pivotally attached to the sheet feeder, and a fitting portion formed in the case, in which the other end of the support rod is fitted when the sheet feeder is pivoted to the non-actuating position.

9. An automatic sheet feeder according to claim 2, wherein the pivoting mechanism includes a pair of hinge members arranged on the upper wall of the case and spaced from each other by a distance larger than width of the continuous paper, the main body being pivotally supported by the hinge members and having a notched portion which is located between the hinge member so that a gap defining a part of the discharge path is formed between the upper wall of the case and the main body when the main body is pivoted to the non-actuating position.

10. The automatic sheet feeder according to claim 1, wherein said printing mechanism includes a platen, and the main body includes means for engaging with the platen to position the main body with reference to the cut sheet supply port and paper discharge port when the main body is moved to the actuating position.

11. An automatic sheet feeder according to claim 2, wherein the pivoting means includes a pair of hinge members arranged on the upper wall of the case, each of the hinge members having a projecting portion which projects upward from the upper wall, and the main body is pivotally supported by the projecting portions of the hinge members so that a gap defining a part of the discharge path is formed between the upper wall and the main body at a region between the hinge members when the main body is pivoted to the non-actuating position.

* * * * *